United States Patent [19]

Everall, Jr. et al.

[11] 4,399,991

[45] Aug. 23, 1983

[54] MECHANISM FOR STACKING AND ACCUMULATING STACKS OF FLAT FLEXIBLE ARTICLES

[75] Inventors: Palmer B. Everall, Jr.; Jack R. Lowery, Sr., both of Lancaster, S.C.

[73] Assignee: Springs Mills, Inc., Fort Mill, S.C.

[21] Appl. No.: 305,593

[22] Filed: Sep. 25, 1981

[51] Int. Cl.[3] ..... B65H 29/54

[52] U.S. Cl. ..... 271/175; 271/309; 271/199; 271/202; 271/209; 226/107

[58] Field of Search ..... 271/69, 309, 175, 190, 271/199, 202, 209; 226/104–107

[56] References Cited

U.S. PATENT DOCUMENTS

| | | | |
|---|---|---|---|
| 1,876,761 | 9/1932 | Rosener | 226/107 X |
| 2,788,967 | 4/1957 | Jesus . | |
| 2,855,089 | 10/1958 | Griffin | 271/175 |
| 3,159,122 | 12/1964 | Hedegaard . | |
| 3,500,780 | 3/1970 | Emus et al. . | |
| 3,580,198 | 5/1971 | Teed . | |
| 3,672,314 | 6/1972 | Firestein et al. . | |
| 3,704,884 | 12/1972 | Nicolay et al. . | |
| 3,712,609 | 1/1973 | Robert . | |

*Primary Examiner*—Richard A. Schacher

*Attorney, Agent, or Firm*—Bell, Seltzer, Park & Gibson

[57] ABSTRACT

A mechanism for stacking and accumulating a plurality of stacks of predetermined numbers of flat flexible articles, such as pillowcases and like products, sequentially received therein, such as from a machine fabricating such articles. A plurality of bar holders sequentially receive the articles in draped-over superimposed position at an entrance end of the mechanism to form separate stacks and are selectively conveyed longitudinally through the mechanism (1) from the entrance end through a stacking section to an accumulating section, (2) incrementally through the accumulating section to an exit end of the mechanism in a plurality of incremental longitudinal distances each of which is less than the longitudinal distance through the stacking section, and (3) back to the entrance end.

8 Claims, 6 Drawing Figures

MECHANISM FOR STACKING AND ACCUMULATING STACKS OF FLAT FLEXIBLE ARTICLES

FIELD OF THE INVENTION

This invention relates to a mechanism for stacking and accumulating a plurality of stacks of predetermined numbers of flat flexible articles, such as pillowcases and like products, sequentially received therein, such as from a machine for fabricating such articles.

BACKGROUND OF THE INVENTION

Various mechanisms have been proposed and commercialized over the years for stacking and accumulating a plurality of stacks of predetermined numbers of flat flexible articles sequentially received by the mechanism either manually or from machines for fabricating such articles. However, all of these mechanisms have suffered from one or more drawbacks including complicacy of construction and operation, size of the apparatus required for providing a section for stacking the articles and a section for accumulating a plurality of the stacks produced, etc.

Accordingly, it is the object of this invention to provide a mechanism of an improved construction for stacking such articles and accumulating a plurality of the stacks formed.

SUMMARY OF THE INVENTION

By this invention, it has been found that the above object may be accomplished by providing such a mechanism which includes a longitudinally-extending frame defining an entrance end and an exit end for the mechanism, and defining at the entrance end an article stacking section having a longitudinal dimension for effecting article stacking, and defining at the exit end a stack accumulating section having a longitudinal dimension for containing a plurality of stacks. A plurality of bar holders are positioned in the mechanism for sequentially receiving a predetermined number of the articles in draped-over superimposed position on each of the bar holders at the entrance end of the mechanism to form separate stacks of the articles.

Selectively-driven conveying means are movably mounted on the frame in the stacking and accumulating sections and carry each of the bar holders in spaced-apart relation for selective movement of each of the bar holders longitudinally through the mechanism (1) from the entrance end through the stacking section to the accumulating section, (2) incrementally through the accumulating section to the exit end in a plurality of incremental longitudinal distances each of which is less than the longitudinal dimension through the stacking section, and (3) back to the entrance end.

Control means are connected with the conveying means for (1) counting the articles sequentially received on an empty one of the bar holders at the entrance end of the mechanism, (2) actuating the conveying means after counting a predetermined number of the articles and deactuating the conveying means after the stacked bar holder has been carried through the stacking section to the accumulating section and each of the previously stacked bar holders has moved forward one of the incremental distances in the accumulating section and an empty one of the bar holders has been carried to the entrance end of the mechanism, (3) sensing a stacked bar holder arriving at the exit end of the mechanism and stopping operation of the mechanism until at least the bar holder at the exit end of the mechanism has been emptied of the stack of articles.

By this construction, a mechanism is provided which is relatively simple in construction and operation and conserves space in its overall inasmuch as the accumulating section, which is adapted to contain a plurality of stacks of articles, moves each stack an incremental distance therethrough which is smaller than the distance required for stacking the individual articles on a particular bar holder in the stacking section.

BRIEF DESCRIPTION OF THE DRAWINGS

Some of the objects and advantages of this invention having been set forth, other objects and advantages will appear when taken in conjunction with the accompanying drawings, in which.

DETAILED DESCRIPTION OF THE INVENTION

Figure 1:
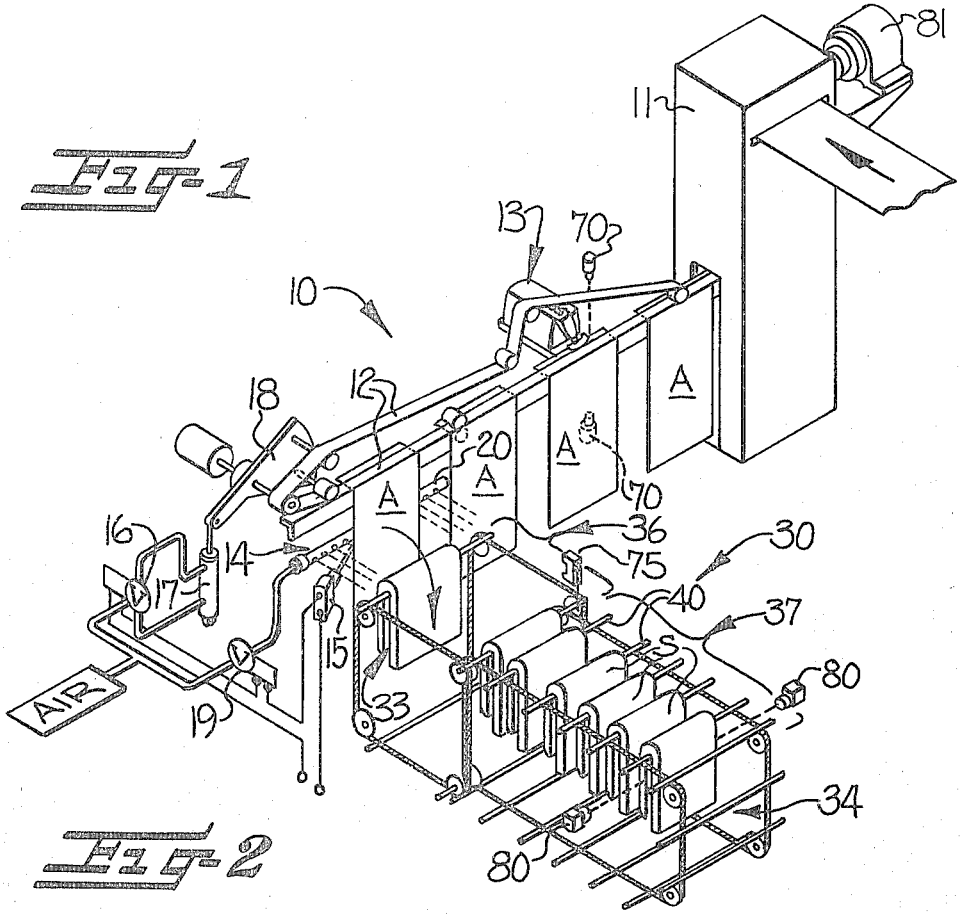
FIG. 1 is a schematic perspective view illustrating the stacking and accumulating mechanism of this invention as used with a machine for fabricating pillowcases.

In the drawings, FIG. 1 schematically illustrates the stacking and accumulating mechanism, generally referred to by the numeral 30 as used in conjunction with an apparatus for fabricating pillowcases, generally referred to by the reference numeral 10. The mechanism 30 receives flat flexible articles A, in the form of fabricated pillowcases, as they are pneumatically doffed from the apparatus 10, stacks the articles A into stacks S of predetermined numbers of such articles A, and accumulates a plurality of the stacks S for subsequent removal by an operator.

However, it is to be understood that the stacking and accumulating mechanism 30 may be used in conjunction with other article fabricating apparatuses or may be used to manually receive flat flexible articles A sequentially for stacking such articles A and accumulating a plurality of such stacks S for removal by an operator.

The apparatus 10 for fabricating pillowcases or like products, which is partially and schematically illustrated in FIG. 1, is disclosed in more detail in commonly assigned, co-pending application Ser. No. 263,686, filed May 14, 1981. Although this pillowcase fabricating apparatus 10 does not form a part of the present invention, reference may be had to such co-pending application for the general construction and operation of such apparatus for background with respect to the present invention.

As illustrated partially in FIG. 1, the pillowcase fabricating apparatus includes a mechanism 11, the details of which need not be illustrated herein, for cutting a continuous length of pillowcase material into individual pillowcase articles A and placing them into a conveying belt mechanism 12 for sequential conveyance thereof past a stitching mechanism 13 and to an air doffing mechanism 14 which pneumatically and sequentially doffs the pillowcases A from the fabricating apparatus 10 to be received by the stacking and accumulating mechanism 30, in a manner to be described below. The doffing mechanism 14 includes a photoelectric cell sensing device 15 which senses the arrival of a fabricated pillowcase A at the end of the apparatus 10 and activates a solenoid valve 16 to operate a pneumatic piston and cylinder device 17 to pivot a mechanical linkage 18 for moving the conveyor belt 12 out of clamping engagement with the fabricated pillowcase A. At the same time, the photoelectric cell sensing device 15 activates a further solenoid valve 19 for supplying air to an apertured pipe 20 to emit a blast of air therefrom for blowing the fabricated pillowcases A from the fabricating apparatus 10 to the stacking and accumulating mechanism 30.

Figure 4:
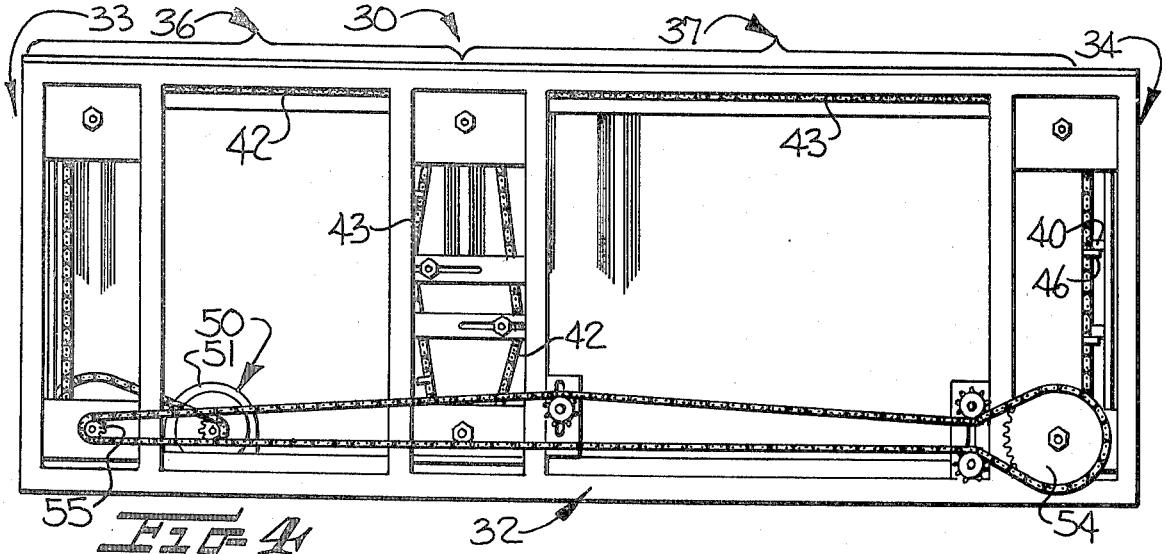
FIG. 4 is a side elevational view of the mechanism of this invention.
Figure 5:
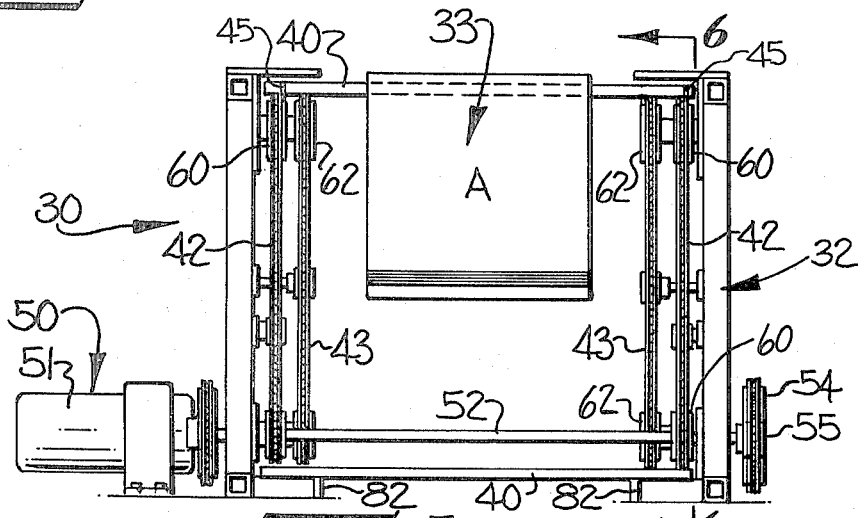
FIG. 5 is an end elevational view of the mechanism of FIG. 4.
Figure 6:
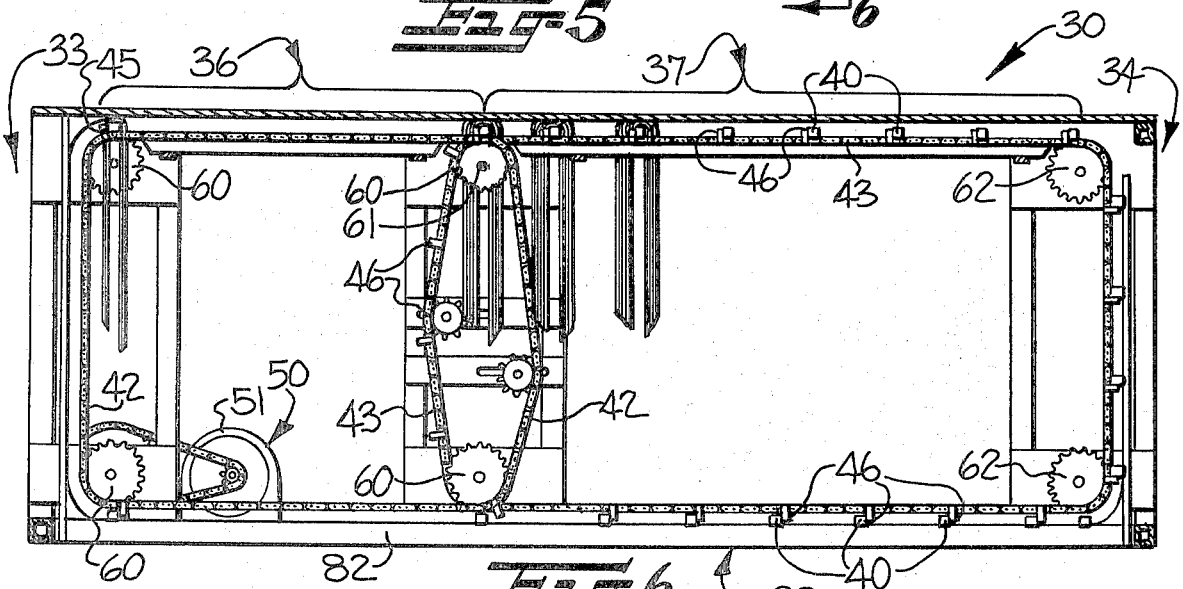
FIG. 6 is a sectional view, taken generally along the lines 6—6 of FIG. 5.

The stacking and accumulating mechanism 30 comprises a longitudinally-extending composite frame 32 (shown in FIGS. 4, 5 and 6). The frame 32 defines an entrance end, generally indicated at 33, and an exit end, generally indicated at 34, for the mechanism 30. The frame 32 further defines at the entrance end 33 an article stacking section 36 having a longitudinal dimension for effecting article stacking and at least half the length of the article A, to be discussed in more detail below. The frame 32 further defines at the exit end 34 a stack accumulating section 37 having a longitudinal dimension sufficient for containing a plurality of the stacks S in a manner to be described below.

The stacking and accumulating mechanism 30 further includes a plurality of bar holders 40 removably positioned in the mechanism 30 for sequentially receiving a predetermined number of the articles A in draped-over superimposed position on each of the bar holders 40 at the entrance end 33 of the mechanism 30 to form separate stacks S of the articles A.

Selectively-driven conveying means in the form of separate pairs of transversely spaced-apart, endless chains 42, 43 are movably mounted on the composite frame 32 in the respective stacking and accumulating sections 36, 37 for removably carrying each of the bar holders 40 in spaced-apart relation for selective movement of each of the bar holders 40 longitudinally through the mechanism 30 (1) from the entrance end 33 through the stacking section 36 to the accumulating section 37, (2) incrementally through the accumulating section 37 to the exit end 34 in a plurality of incremental longitudinal distances each of which is less than the longitudinal dimension through the stacking section 36, and (3) back to the entrance end 33.

Figure 3:
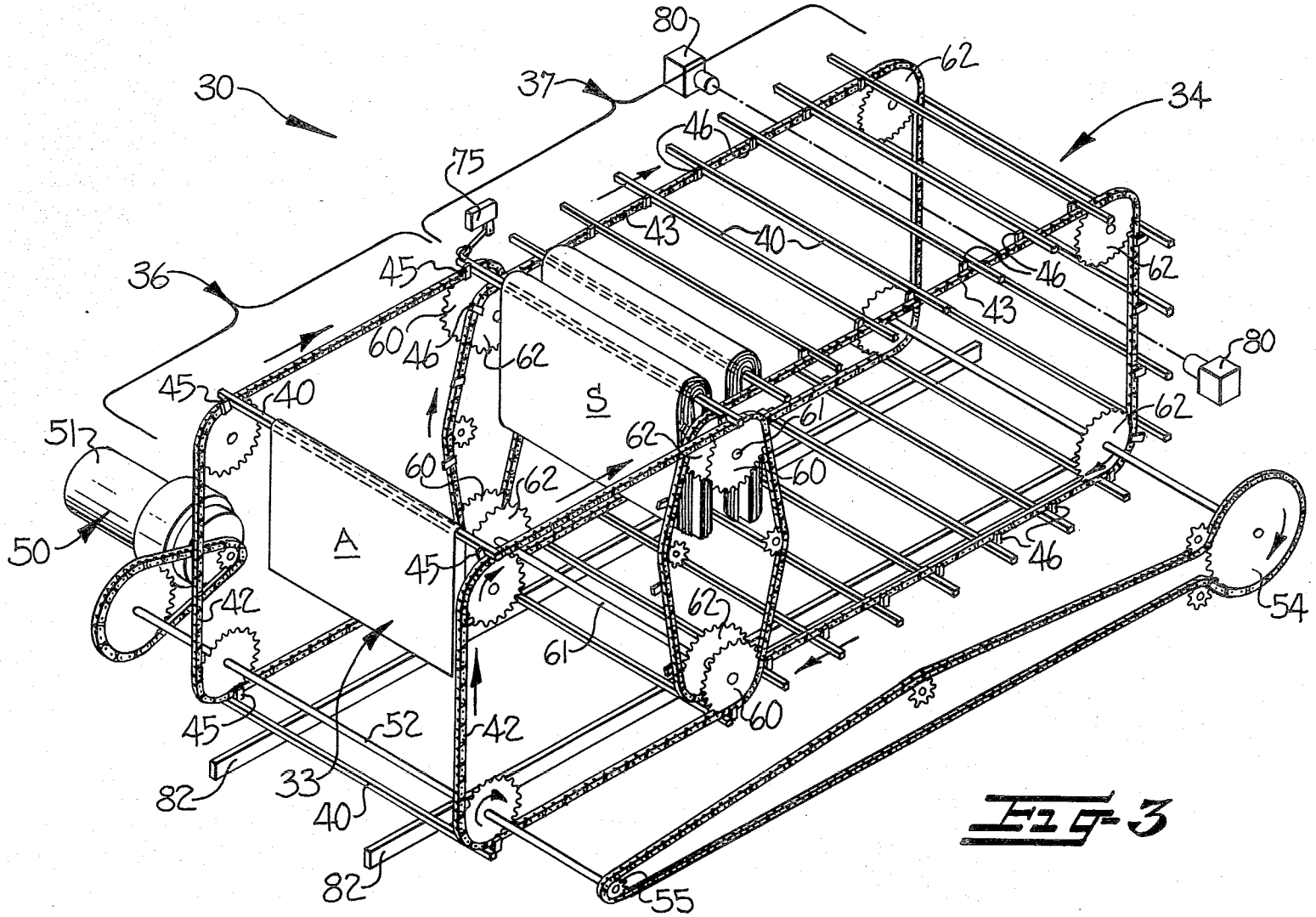
FIG. 3 is an enlarged schematic perspective view of the mechanism of this invention.

The pairs of endless chains 42, 43 extend in the longitudinal direction of the mechanism 30 and define overlapping upper flights selectively moving from the entrance end 33 to the exit end 34 of the mechanism 30 for carrying the stacked bar holders 40, and overlapping lower flights selectively moving from the exit end 34 to the entrance end 33 for carrying empty bar holders 40 (indicated by the arrows in FIG. 3).

The conveying means further includes outwardly-extending spaced-apart finger members 45, 46 mounted on the respective pairs of endless chains 42, 43 for engaging and spacing the bar holders 40 on each of the pairs of endless chains 42, 43 (shown particularly in FIG. 3). The finger members 45 on the pair of endless chains 42 mounted in the stacking section 36 are spaced-apart a distance corresponding to the longitudinal dimension of the stacking section (shown in FIG. 3). The finger members 46 on the pair of endless chains 43 mounted in the accumulating section 37 are spaced-apart a distance less than the distance of spacing of the finger members 45 on the pair of endless chains 42 in the stacking section. The above spacing of the finger members 45, 46 will be discussed in more detail below.

The conveying means further includes a selectively actuatable drive means, generally indicated at 50, connected with the pairs of endless chains 42, 43 for rotation of the pairs of endless chains 42 mounted in the stacking section 36 at a predetermined speed and for rotation of the pair of endless chains 43 mounted in the accumulating section 37 at a predetermined speed less than the predetermined speed of rotation of the pair of endless chains 42 mounted in the stacking section 36, for reasons to be discussed more fully below. This selectively actuatable drive means include a selectively actuatable electric motor 51 which drives a shaft 52 for driving the pair of endless chains 42 mounted in the stacking section 36 through suitable sprockets upon which the endless chains 42 are mounted (shown particularly in FIG. 3). The shaft 52 also drives a sprocket gear 54 through a sprocket gear 55 and chain 56. The sprocket gear 54 in turn drives a shaft 56 which drives the pair of endless chains 43 in the accumulating section 37 through suitable sprockets upon which the chains 43 are mounted. As may be seen in the drawings, the sprocket gear 54 is larger than the sprocket gear 55 and, therefore, the pair of chains 43 in the accumulating section 37 are driven at a speed slower than the pair of endless chains 42 mounted in the stacking section 36, for purposes to be discussed more fully below.

It should also be noted that idler sprockets 60 for the endless chains 42 in the stacking section 36 are mounted on common shafts 61 with idler sprockets 62 for the pair of endless chains 43 in the accumulating section 37, so that as the bar holders 40 are conveyed longitudinally forwardly through the mechanism 30, each bar holder 40 will be picked up from fingers 45 on the chains 42 in the stacking section 36 by the fingers 46 on the chains 43 in the accumulating section 37 as such bar holders 40 reach the accumulating section 37.

The stacking and accumulating mechanism 30 further includes (shown particularly in FIG. 2), a control means connected with the conveying means for (1) counting the articles sequentially received on an empty one of the bar holders 40 at the entrance end 33 of the mechanism 30, (2) actuating the conveying means after counting a predetermined number of articles A and deactuating the conveying means after the stacked bar holder 40 has been carried through the stacking section 36 to the accumulating section 37 and each of the previously stacked bar holders 40 has moved forward one of the incremental longitudinal distances in the accumulating section 37 and an empty one of the bar holders 40 has been carried to the entrance end 33 of the mechanism 30, and (3) sensing a stacked bar holder 40 arriving at the exit end 34 of the mechanism 30 and stopping operation of the mechanism 30 until at least the bar holder 40 at the exit end 34 of the mechanism 30 has been emptied of its stack S of articles A.

This control means (shown in FIG. 2), comprises an electrical circuit means connected with the selectively-driven conveying means and particularly with the selectively actuatable motor 51 for actuating and deactuating the motor 51 for actuating and deactuating driven movement of the pairs of endless chains 42, 43 upon activation and deactivation of the circuit means. A first sensing means, which may be in the form of a photoelectric cell device 70 in the fabricating apparatus 10, is connected in the circuit means for sensing each article A passing through the apparatus 10 and received on the bar holder 40 positioned at the entrance end 33 of the mechanism 30. As illustrated in FIG. 1, when the stacking and accumulating mechanism is used in conjunction with the pillowcase fabricating apparatus 10 this photoelectric cell sensing device 70 may be positioned in advance of the sewing machine 13 for performing additional functions in the fabricating apparatus 10. However, the photoelectric cell sensing device could be positioned and function at the entrance end of the mechanism 30, if the stacking and accumulating mechanism 30 is used apart from the fabricating apparatus 10 or with other apparatus.

The control means further includes a counting mechanism 71 which may be any suitable, commercially available, well understood counting mechanism. The counter mechanism 71 has an adjustable manual preset that determines the number of articles A per stack S to be stacked on a bar holder 40. The counting mechanism 71 is connected in the electrical circuit with the photoelectric cell sensing device 70 to receive count signals from the photoelectric cell sensing device 70. The counter mechanism 71 counts backwards from the manual preset number and when the counter mechanism 71 reaches 0, an internal relay therein energizes which in turn energizes a resettable coil timing relay 72 that is electrically connected with the counter 71. The relay 72 includes switches 72*a* and 72*b* as a part thereof so as to close these switches during the timed actuation of relay 72. When the switches 72*a* and 72*b* are closed, the electrical circuit to the motor 51 will be activated to cause driving movement of the pairs of endless chains 42, 43 constituting the bar holder conveying means.

As the bar holders 40 move forwardly in their longitudinal travel through the mechanism 30, a second sensing means, in the form of a proximity switch 75, will be closed or activated which maintains the electrical circuit means to the motor 51 activated until the just previously stacked bar holder 40 reaches the accumulating section 37 from the stacking section 36 to again open the proximity switch 75 and deactivate the electrical circuit means to the motor 51 and deactuate movement of the bar holder conveying means.

The control means further includes a third sensing means, in the form of a photoelectric cell sensing device 80, which is positioned at generally the exit end 34 of the mechanism 30 so that when a stacked bar holder 40 reaches the exit end 34 of the mechanism 30, the sensing means 80 will sense its arrival and deactivate the circuit means until at least the bar holder 40 at the exit end 34 has been emptied of its stack S of articles A.

Figure 2:
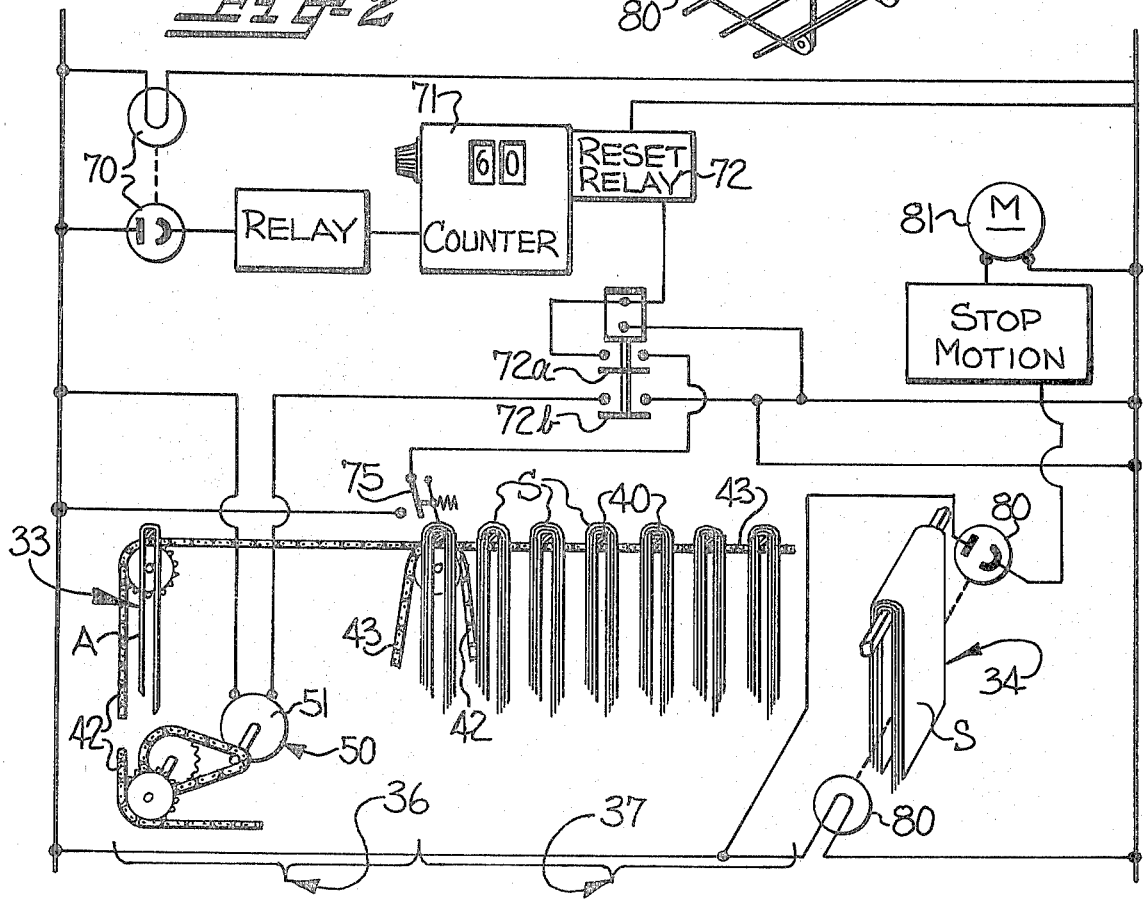
FIG. 2 is a schematic view of the electrical control circuit for the mechanism of this invention.

In the environment of FIG. 1 and as illustrated in FIG. 2, the photoelectric cell sensing device 80 may be connected to a suitable stop-motion device of a main drive motor 81 of the pillowcase fabricating apparatus 10 so as to stop operation of such apparatus 10 and, therefore, operation of the mechanism 30 since no pillowcase A will be received in the mechanism 30 when the apparatus 10 is stopped. However, if the stacking and accumulating mechanism 30 is not used in conjunction with the pillowcase fabricating apparatus 10, the photoelectric cell sensing device 80 could be connected directly with the drive motor 51 in the stacking and accumulating mechanism 30 so as to deactivate the entire electrical circuit means to the drive motor 51 until such time as the stack S of articles A has been removed from the bar holder 40 arriving at the exit end 34 of the mechanism 30.

With the above construction of the stacking and accumulating mechanism 30, it may be seen that flat flexible articles A, such as fabricated pillowcases, are sequentially received onto a bar holder 40 positioned at the entrance end 33 of the mechanism 30 and in the stacking section 36, such as by an air blast from the doffing mechanism 14 of the pillowcase fabricating apparatus 10. Since the articles A are stacked on the bar holder 40 in draped-over superimposed position, the longitudinal dimension of the stacking section 36 must be such as to accommodate at least one half the length of the article A. The articles A are counted by the control means as they are stacked on the bar holder 40. When a predetermined number of such articles A are received on the bar holder 40 to constitute a desired stack S, the control means actuates the conveying means to drive the pairs of endless chains 42, 43 to move the stacked bar holder 40 forwardly and completely through the stacking section 36 to the accumulating section 37, due to the spacing of the finger members 45 on the endless chains 42. The stacked bar holder is then picked up by the fingers 46 on the endless chains 43. Arrival of the stacked bar holder 40 in the accumulating section deactuates the control means to stop the movement of the endless chains 42, 43.

By this time, an empty bar holder 40, which has traveled downwardly and rearwardly along the lower flights of the pairs of endless chains 42, 43 by sliding movement over stationary slide members 82, has reached the entrance end 33 of the mechanism 30 for beginning a new stack S of articles A on such empty bar holder 40. Meanwhile, each of the stacked bar holders 40 in the accumulating section 37 has moved forwardly an incremental longitudinal distance equal generally to the spacing between fingers 46 on the pair of conveyor chains 43, due to such spacing of the fingers 46 and the slower speed of movement of the pair of chains 43. By this arrangement, a plurality of stacks S can be moved short distance through the accumulating section 37 and accumulated therein prior to one of the stacked bar holders 40 reaching the exit end 34 of the mechanism 30 in the accumulating section 37. When such stacked bar holder 40 does reach the exit end 34 in the accumulating section 37 of the mechanism 30, all of the stacked bar holders 40 can be doffed by an operator, or at least the one stacked bar holder 40 at such exit end 34, so as to allow continued operation of the mechanism 30.

By the above construction of such stacking and accumulating mechanism 30, a simply constructed and operated mechanism has been provided which conserves space in that the stacks S of articles A are moved shorter distances at a slower speed through an accumulating section 37 than they are moved through the stacking section 36.

In the drawing and specification, there has been set forth a preferred embodiment of the invention and although specific terms are employed, they are used in a generic and descriptive sense only and not for purposes of limitation.

What is claimed is:

1. Mechanism for stacking and accumulating a plurality of stacks of predetermined numbers of flat flexible articles, such as pillowcases and like products, sequentially received therein, such as from a machine fabricating such articles; said mechanism comprising:

longitudinally-extending frame means defining an entrance end and an exit end for said mechanism, and defining at said entrance end an article stacking section having a longitudinal dimension for effecting article stacking, and defining at said exit end a stack accumulating section having a longitudinal dimension for containing a plurality of stacks;

a plurality of bar holders positioned in said mechanism for sequentially receiving a predetermined number of the articles in draped-over superimposed position on each of said bar holders at said entrance end of said mechanism to form separate stacks of the articles;

selectively-driven conveying means movably mounted on said frame means in said stacking and accumulating sections and carrying each of said bar holders in spaced-apart relation for selective movement of each of said bar holders longitudinally through said mechanism (1) from said entrance end through said stacking section to said accumulating section, (2) incrementally through said accumulating section to said exit end in a plurality of incremental longitudinal distances each of which is less than the longitudinal dimension through said stacking section, and (3) back to said entrance end; and control means connected with said conveying means for (1) counting the articles sequentially received on an empty one of said bar holders at said entrance end of said mechanism, (2) actuating said conveying means after counting a predetermined number of articles and deactuating said conveying means after said stacked bar holder has been carried through said stacking section to said accumulating section and each of the previously stacked bar holders has moved forward one of the incremental distances in said accumulating section and an empty one of said bar holders has been carried to said entrance end of said mechanism, and (3) sensing a stacked bar holder arriving at said exit end of said mechanism and stopping operation of said mechanism until at least said bar holder at said exit end of said mechanism has been emptied of the stack of articles.

2. Mechanism, as set forth in claim 1, in which said conveying means comprises a separate pair of transversely spaced-apart endless chains mounted for rotation in said respective stacking section and accumulating section and extending in the longitudinal direction of said mechanism and defining overlapping upper flights selectively moving from said entrance end to said exit end of said mechanism for removably carrying stacked bar holders thereon and overlapping lower flights selectively moving from said exit end to said entrance end of said mechanism for carrying empty bar holders;

outwardly-extending spaced-apart finger members mounted on said pairs of endless chains for engaging and spacing said bar holders on each of said pairs of endless chains, said finger members on said pair of endless chains mounted in said stacking section being spaced-apart a distance corresponding to the longitudinal dimension of said stacking section and said finger members on said pair of endless chains mounted in said accumulating section being spaced-apart a distance less than distance of spacing of said finger members on said endless chains in said stacking section; and selectively actuable drive means connected with said pairs of endless chains for rotation of said pair of endless chains mounted in said stacking section at a predetermined speed and for rotation of said pair of endless chains mounted in said accumulating section at a predetermined speed less than the predetermined speed of rotation of said pair of endless chains mounted in said stacking section.

3. Mechanism, as set forth in claim 1 or 2, in which said control means comprises electrical circuit means connected with said selectively-driven conveying means for actuating and deactuating the driven movement of said conveying means upon activation and deactivation of said circuit means;

first sensing means connected in said circuit means for sensing each article received on said bar holder positioned at said entrance end of said mechanism;

counting means connected in said circuit means and of articles sensed by said first sensing means and for activating said circuit means upon counting the predetermined number of articles;

second sensing means connected in said circuit means for sensing the arrival of a stacked bar holder from said stacking section in said accumulating section and for deactivation said circuit means until further activation of said circuit means by said counting means; and third sensing means connected in said circuit for sensing the arrival of a stacked bar holder at said exit end of said mechanism for deactivating said circuit means until at least said bar holder at said exit end of said mechanism has been emptied of the stack of articles.

4. Mechanism, as set forth in claim 3, in which said counting means is adjustable for varying the predetermined number of articles being counted thereby and stacked in said mechanism.

5. In apparatus for sequentially fabricating pillowcases or like products and including means for sequentially doffing the finished pillowcases from said apparatus; the combination therewith of a mechanism for sequentially receiving, stacking and accumulating a plurality of stacks of predetermined numbers of the finished pillowcases comprising:

longitudinally-extending frame means defining an entrance end positioned adjacent said doffing means of said fabricating apparatus and an exit end for said mechanism, and defining at said entrance end an article stacking section having a longitudinal dimension for effecting pillowcase stacking, and defining at said exit end a stack accumulating section having a longitudinal dimension for containing a plurality of stacks of pillowcases;

a plurality of bar holders positioned in said mechanism for sequentially receiving a predetermined number of the pillowcases in draped-over superimposed position on each of said bar holders at said entrance end of said mechanism as they are received from said doffing means of said fabricating apparatus to form separate stacks of the pillowcases;

selectively-driven conveying means movably mounted on said frame means in said stacking and accumulating sections and carrying each of said bar holders in spaced-apart relation for selective movement of each of said bar holders sequentially and longitudinally through said mechanism (1) from said entrance end through said stacking section to said accumulating section, (2) incrementally through said accumulating section to said exit end in a plurality of incremental longitudinal distances each of which is less than the longitudinal dimension through said stacking section and (3) back to said entrance end; and control means connected with said conveying means for (1) counting the pillowcases sequentially received on an empty one of said bar holders at said entrance end of said mechanism, (2) actuating said conveying means after counting a predetermined number of the pillowcases and deactuating said conveying means after said stack bar holder has been carried through said stacking section to said accumulating section and each of the previously stacked bar holders has moved forward one of the incremental distances in said accumulating section and an empty one of said bar holders has been carried to said entrance end of said mechanism, and (3) sensing a stacked bar holder arriving at said exit end of said mechanism and stopping operation of said mechanism until at least said bar holder at said exit end of said mechanism has been emptied of the stack of pillowcases.

6. Mechanism, as set forth in claim 5, in which said conveying means comprises a separate pair of transversely spaced-apart endless chains mounted for rotation in said respective stacking section and accumulating section and extending in the longitudinal direction of said mechanism and defining overlapping upper flights selectively moving from said entrance end to said exit end of said mechanism for removably carrying stacked bar holders thereon and overlapping lower flights selectively moving from said exit end to said entrance end of said mechanism for carrying empty bar holders;

outwardly-extending spaced-apart finger members mounted on said pairs of endless chains for engaging and spacing said bar holders on each of said pairs of endless chains, said finger members on said pair of endless chains mounted in said stacking section being spaced-apart a distance corresponding to the longitudinal dimension of said stacking section and said finger members on said pair of endless chains mounted in said accumulating section being spaced-apart a distance less than distance of spacing of said finger members on said endless chains in said stacking section; and selectively actuatable drive means connected with said pairs of endless chains for rotation of said pair of endless chains mounted in said stacking section at a predetermined speed and for rotation of said pair of endless chains mounted in said accumulating section at a predetermined speed less than the predetermined speed of rotation of said pair of endless chains mounted in said stacking section.

7. Mechanism, as set forth in claim 5 or 6, in which said control means comprises electrical circuit means connected with said selectively-driven conveying means for actuating and deactuating the driven movement of said conveying means upon activation and deactivation of said circuit means;

first sensing means connected in said circuit means for sensing each article received on said bar holder positioned at said entrance end of said mechanism;

counting means connected in said circuit means and with said first sensing means for counting a predetermined number of articles sensed by said first sensing means and for activating said circuit means upon counting the predetermined number of articles;

second sensing means connected in said circuit means for sensing the arrival of a stacked bar holder from said stacking section in said accumulating section and for deactivating said circuit means until further activation of said circuit means by said counting means; and third sensing means connected in said circuit for sensing the arrival of a stacked bar holder at said exit end of said mechanism for deactivating said circuit means until at least said bar holder at said exit end of said mechanism has been emptied of the stack of articles.

8. Mechanism, as set forth in claim 7, in which said counting means is adjustable for varying the predetermined number of articles being counted thereby and stacked in said mechanism.

* * * * *